US008808082B2

(12) United States Patent
Ghaly, Jr.

(10) Patent No.: US 8,808,082 B2
(45) Date of Patent: Aug. 19, 2014

(54) INTERACTIVE SLOT MACHINE

(76) Inventor: Nabil N. Ghaly, Jr., South Huntington, NY (US)

( * ) Notice: Subject to any disclaimer, the term of this patent is extended or adjusted under 35 U.S.C. 154(b) by 578 days.

(21) Appl. No.: 11/599,553

(22) Filed: Nov. 15, 2006

(65) Prior Publication Data

US 2007/0117605 A1 May 24, 2007

Related U.S. Application Data

(60) Provisional application No. 60/738,426, filed on Nov. 21, 2005.

(51) Int. Cl.
*A63F 9/24* (2006.01)
*G07F 17/34* (2006.01)

(52) U.S. Cl.
CPC ..... *G07F 17/34* (2013.01)
USPC ..... 463/20; 463/16; 463/17; 463/18; 463/19

(58) Field of Classification Search
USPC ..... 463/16–20
See application file for complete search history.

(56) References Cited

U.S. PATENT DOCUMENTS

| | | | | | |
|---|---|---|---|---|---|
| 4,200,291 | A * | 4/1980 | Hooker | 273/143 R |
| 4,700,948 | A * | 10/1987 | Okada | 273/143 R |
| 5,720,662 | A * | 2/1998 | Holmes et al. | 463/20 |
| 6,942,571 | B1 * | 9/2005 | McAllister et al. | 463/20 |
| 2003/0190946 | A1 * | 10/2003 | Baerlocher | 463/20 |
| 2004/0048650 | A1 * | 3/2004 | Mierau et al. | 463/20 |
| 2004/0063483 | A1 * | 4/2004 | Wolf et al. | 463/13 |
| 2004/0097280 | A1 * | 5/2004 | Gauselmann | 463/16 |
| 2004/0127280 | A1 * | 7/2004 | Moody | 463/20 |
| 2006/0189377 | A1 * | 8/2006 | Gomez et al. | 463/20 |

* cited by examiner

*Primary Examiner* — Steve Rowland

(57) ABSTRACT

An interactive gaming device that employs a plurality of reels (mechanical or simulated) is disclosed, and includes means for the player to establish a movement direction for a reel after it comes to a complete stop. The player is also provided with a plurality of switches to establish a condition upon which the reel would move after it comes to a complete stop. The device includes a control mechanism that causes the reel to move after it comes to a complete stop when the condition established by the player is met. A determination is then made if a winning combination of symbols has occurred at a winning line.

23 Claims, 10 Drawing Sheets

| ARROW SWITCHES SETTING | EFFECTIVE WINNING LINE |
|---|---|
| N N N | |
| N N U | |
| N N D | |
| N U N | |
| N U U | |
| N U D | |
| N D N | |
| N D U | |

Figure – 2 -

| ARROW SWITCHES SETTING | EFFECTIVE WINNING LINE |
|---|---|
| N D D | |
| U N N | |
| U N U | |
| U N D | |
| U U N | |
| U U U | |
| U U D | |
| U D N | |

Figure – 3 -

| ARROW SWITCHES SETTING | EFFECTIVE WINNING LINE |
|---|---|
| U D U | |
| U D D | |
| D N N | |
| D N U | |
| D N D | |
| D U N | |
| D U U | |
| D U D | |

Figure – 4 -

| ARROW SWITCHES SETTING | EFFECTIVE WINNING LINE |
|---|---|
| D U D | |
| D D N | |
| D D U | |
| D D D | |

Figure – 5 -

| POSSIBLE REEL ACTION | EFFECTIVE WINNING LINE |
|---|---|
| D U D | |
| N U D | |
| N U N | |
| N N D | |
| N N N | |
| D N D | |
| D N N | |
| D U N | |

Figure – 10 -

INTERACTIVE SLOT MACHINE

PARENT CASE TEXT

This utility application benefits from provisional application of U.S. Ser. No. 60/738,426, filed on Nov. 21, 2005.

BACKGROUND OF THE INVENTION

This invention relates generally to slot machines, also known as coin operated gaming machines, and more specifically to a category of slot machines wherein one, or a plurality of reels may move up or down by one position to place a symbol at a winning line after the reels come to a complete stop.

Slot machines are well known, and have been around for many years. A traditional mechanical slot machine includes a plurality of symbols that are mapped on the periphery of a plurality of rotating reels. The reels are randomly stopped and a win decision is made based on the combination of symbols stopping on a single winning line, or a plurality of winning lines. One popular category of slot machines employs a feature that causes one, or a plurality of the reels, to move such that a symbol or a plurality of symbols are placed at a winning line after the reels come to a complete stop. A reel can move up or down by one position, and the winning decision is made after such move or moves take place. Examples of such gaming machines include the "Double Diamond" slot machines, wherein certain symbols incorporate an up and/or down arrow. If a reel is stopped such that a symbol with an arrow pointing to the winning line is one position away from said winning line, then the reel will move one position to place that symbol at the winning line. A second example is the "Phantom" slot machine, wherein the movement of a symbol towards the winning line does not depend on the position of an arrow symbol relative to a wining line, and appears to be random to the player.

In both of the above described examples, the player has no control over when or in what direction a symbol may move towards a winning line. The slot machine described in this invention incorporates manual controls that enable a player to manually establish this feature for one or a plurality of reels before the start of game play.

Object of the Invention

Because it is desirable to offer players a new variety of slot machines based on interactive game play, it is an object of this invention to provide a coin operated gaming device that enables a player, before the start of game play, to manually establish for a reel to move up or down by one position after the reel comes to a complete stop.

It is another object of this invention to provide a slot machine that enables a player to manually control when and in what direction a reel may move after it comes to a complete stop, for one or a plurality of symbols that are selected by the player.

It is a further object of this invention to provide a slot machine that enables a player to define if the movement of the reel is conditional upon placing a selected symbol at a winning line, or if such movement should take place in each game, and independent of placing a symbol at a winning line.

It is also an object of this invention to provide a slot machine that enables a player to define whether or not the reel moves in a selected direction if there is a symbol at the winning line when the reel comes to a complete stop.

It is still an object of this invention to provide a slot machine, which incorporates an algorithm that dynamically calculates the probability of occurrence of winning combinations based on the manual control settings established by the player.

It is another object of this invention to provide a coin operated gaming machine, which incorporates a variety of visual and audible indications to heighten the enjoyment of play.

SUMMARY OF THE INVENTION

The foregoing and other objects of the invention are accomplished by an interactive slot machine that incorporates a plurality of input control mechanisms to enable a player to manually establish when a reel moves up or down after the reel comes to a complete stop.

In accordance with a preferred embodiment of the invention, the interactive feature is provided for a slot machine that employs three rotating reels. Two switches are provided for each reel to enable the player to establish if and in what direction, the reel should move after it comes to a complete stop. The switches are shaped as arrows, and are located above and below the transparent window that reveals the rotating reels. A set of indicators are provided to inform the player of the selected direction of movement for each reel. It is preferable that these indicators be incorporated in the arrow shaped switches such that the arrow symbol on a switch illuminates if the movement of the reel is established in the direction indicated by the arrow. If a player elects not to move a specific reel after it comes to a complete stop, then both the up and down indicators associated with that reel will be unilluminated.

The preferred embodiment, also, includes a movement control switch to enable a player to specify whether or not the movement of a reel is conditioned upon placing a selected symbol at a winning line, or if such movement is to take place irrespective of the presence of a symbol one position away from the winning line. The player is also provided with a set of switches to select the specific symbols that would trigger a reel movement. In addition, the player is provided with a "HOLD" switch to inhibit the movement of a reel in the event there is a symbol at the winning line when the reel comes to a complete stop.

To establish a direction for a reel movement, the player activates the "UP" or "DOWN" arrow switches associated with the reel either once or twice. For example, if a direction has been established for a reel to move to the up position, the first activation of the "DOWN" arrow cancels the "UP" movement and the second activation of said "DOWN" arrow establishes the down movement.

To define the conditions upon which the reels would move, the player first selects a setting for the "MOVEMENT CONTROL SWITCH." If the player selects the "ON" position, the movement of a reel will be conditioned upon the presence of a selected symbol one position away from a winning line. Conversely, in the "OFF" position a reel always moves in the selected direction unless the player activates the "HOLD" switch. Further, if the player selects the "ON" position, then it is necessary for the player to select up to three symbols that would trigger such movement of the reels.

The second set of controls enables a player to selectively identify a specific symbol, or symbols, that would trigger the movement of a reel in the direction established by the player when the reel stops with that symbol located one position away from the winning line (provided that the movement control switch is in the "ON" position). In the preferred embodiment, the player can select up to three individual symbols for this feature.

An optional switch is also provided for the preferred embodiment to enable the player to define if the reel movement should take place if a symbol is located at a winning line when the reel comes to a complete stop. If the player selects the "RELEASE" position on this control switch, then any reel with an established movement direction moves in that direction even if it results in the movement of a symbol at a winning line away from that winning line. Alternatively, if the player selects the "HOLD" position of this control switch, then if a reel stops such that a symbol is located at a winning line, that reel is held in its stopped position even though the player had established a movement direction for that reel. This feature is useful in slot machines that have a symbol at each location on the perimeter of the rotating reel, or when a blank position is part of a winning combination. The selection of the "RELEASE" position could have the effect of replacing one symbol with another symbol. This could result in transforming a losing combination to a winning combination, or vice versa.

It should be noted that the use of the "MOVEMENT CONTROL SWITCH" and the "HOLD/RELEASE" switch in the preferred embodiment is a design choice, and does not limit the invention herein. A simple implementation of the new concept described herein would only require the use of a set of switches to establish a movement direction for each reel. The conditions that trigger such movement could be established as a fixed design parameter in such simple implementation. For example, the symbol or symbols that would trigger the movement of a reel could be fixed in a particular embodiment. Also, a default condition could be to hold the movement of a reel if a symbol is located at a winning line when the reel comes to a complete stop. As would be appreciated by a person skilled in the art, there are many embodiments that could be built using the concepts disclosed herein.

It should, also, be noted that the use of mechanical reels to describe the preferred embodiment is only provided as an example, and is not intended to limit the invention herein. As would be appreciated by a person skilled in the art, the present invention could be implemented using a video slot machine, wherein the rotating reels are simulated on the screen. Under such an implementation, the interactive controls could be implemented using electromechanical switches, or could be integrated as soft switches (touch control) on the display screen. Further, it should be understood that the number of reels, and number of winning lines are design choices to be selected by the game designer.

BRIEF DESCRIPTION OF THE DRAWINGS

These and other more detailed and specific objectives will be disclosed in the course of the following description taken in conjunction with the accompanying drawings wherein:

FIGS. 2-5 indicate all possible settings for the arrow switches, and the corresponding effective winning line for each setting.

FIG. 10 indicates all possible winning lines for the arrow switches setting of"DOWN-UP-DOWN."

DESCRIPTION OF THE PREFERRED EMBODIMENT

Figure 1:
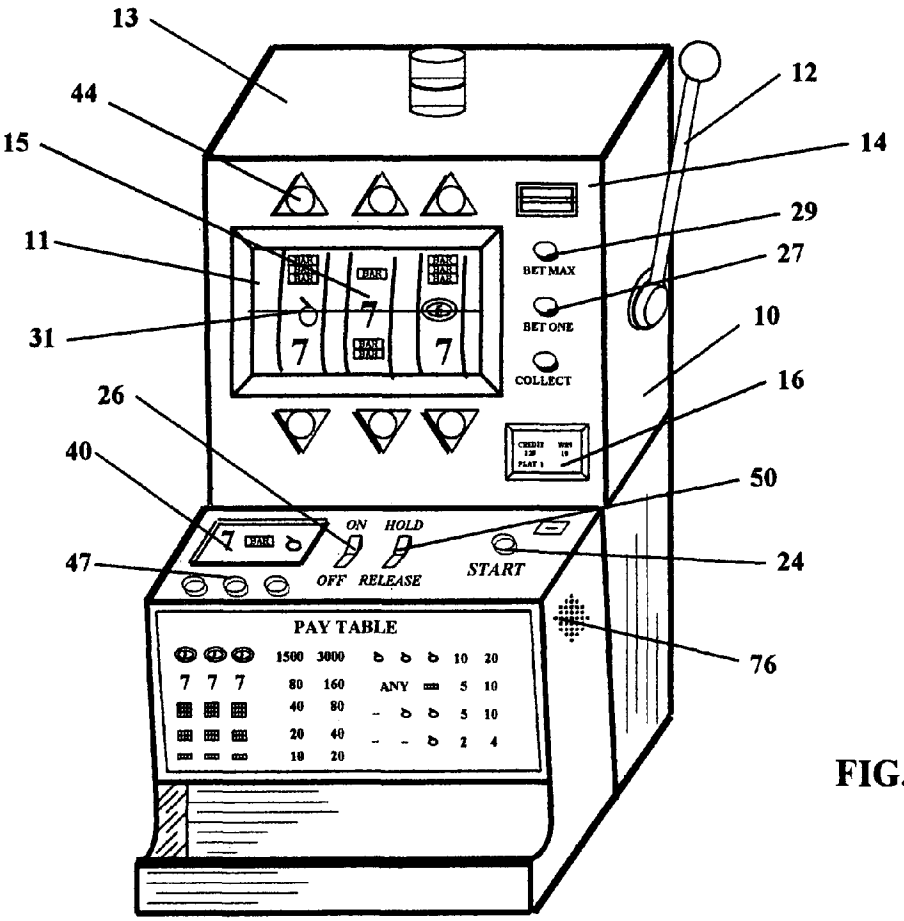
FIG. 1 is a perspective view of the preferred embodiment of a coin operated gaming machine according to the invention.

Referring now to the drawings where the illustrations are for the purpose of describing the preferred embodiment of the invention and are not intended to limit the invention hereto, FIG. 1 is a front plan view of a slot machine 10, which is comprised of a housing 13 having a face 14 and a transparent glass window 11 revealing three rotating reels 15. The height of the window is such that at least three positions on each reel are visible to the player. Overall, the symbols at nine playing positions are visible through the glass window when the reels come to a stop. The preferred embodiment provides a single horizontal winning line, which is indicated on the surface of the window. The slot machine 10, also, has conventional controls including an activation lever 12, a start button 24, "BET ONE" 27 and "BET MAX" 29 buttons. Further, the preferred embodiment includes a Liquid Crystal Display (LCD) screen 16, which provides game information to the player that includes the number of coins played, number of coins won, and balance of remaining coins.

In addition, the preferred embodiment employs a plurality of switches to enable a player to use the interactive features of the present invention. The first set of switches 44 consists of two push buttons per reel that are shaped as arrows. The "UP" arrow push button enables a player to establish a reel movement in the up direction. Similarly, a "DOWN" arrow push button enables a player to establish a movement in the down direction. It should be noted that the use of an "UP" and "DOWN" arrow switches to establish a direction for the movement of a reel is being disclosed for the purpose of describing the preferred embodiment, and is not intended to limit the invention herein. As would be appreciated by a person skilled in the art, other configurations could be used to establish a direction for the movement of a reel. For example, a single switch could be used per reel such that when this switch is activated to an "ON" position by a player, the control program randomly selects an "UP" or a "DOWN" direction for the movement of a reel after it comes to a complete stop.

The "MOVEMENT CONTROL SWITCH." 26 enables a player to define if the reel movements are conditioned upon placing a selected symbol at the winning line 31. If the player selects the "ON" position for this switch, then it is necessary for the player to select at least one symbol that would trigger the movement of a reel. In the preferred embodiment, the player can select up to a maximum of three symbols. Alternatively, if this switch is set to the "OFF" position, then a reel moves unconditionally by one position in the direction established by the player after it comes to a complete stop. However, if the "HOLD" feature of the hold/release switch 50 is activated then a reel does not move when a symbol is located at the winning line. The preferred embodiment also includes an indicator to provide the status of the "MOVEMENT CONTROL SWITCH." It is preferable that this indicator be incorporated into the switch, such that the switch is illuminated when it is set to the "ON" position.

To select the specific symbol, or symbols, which would trigger the movement of a reel, the player is provided with three push buttons 47, and an LCD screen 40 that indicates his or her selection. The LCD screen has three display positions, each of which is used to indicate a symbol. The push buttons are located below the LCD screen, such that each button 47 is aligned below a display position. Each activation of a button 47 scrolls the available choices by one position at the corresponding display location of the LCD screen 40. The player can select any of a predefined plurality of symbols that could include a "blank." If the player elects to identify fewer symbols than the maximum number allowed (three for the preferred embodiment), then he or she could choose the "no selection" option, which is indicated by the term "NONE." For the preferred embodiment, the player is provided with the following symbol choices: cherry, single bar, double bar, triple bar, lucky seven, five multiplier, and "NONE." If the player selects two identical symbols at two different display positions, then such a selection is equivalent to only one symbol, the selected symbol. Also, if the player selects "NONE" at all three display positions, then such a selection is equivalent to the "OFF" setting at the "MOVEMENT CONTROL SWITCH" 26. It should be noted that the maximum number of allowed symbols is independent of the number of reels used, and is only constraint by the total number of symbols employed by the machine. As would be obvious to a person skilled in the art, the maximum number of allowed symbols could be 1, 2, 3, 4 or 5.

The preferred embodiment also includes a control switch 50 to enable a player to suppress the movement of a reel if a symbol is located at the winning line. If the player activates this switch to the "HOLD" position, and in the event a reel stops such that a symbol is located at a winning line, then that reel is held in its stopped position even though the player had established a movement direction for that reel. Conversely, the selection of the "RELEASE" position could result in the movement of a reel even though a symbol is located at the winning line. This could have the effect of replacing one symbol with another symbol, which could result in transforming a losing combination to a winning combination, and vice versa. This feature is useful in slot machines that have a symbol at each location on the perimeter of a rotating reel, or when a winning combination includes the blank position at each reel 15.

Once a player has established his or her interactive settings, and upon the deposit of a wager, the player can operate the slot machine similar to a conventional machine. The interactive settings will remain in effect until they are changed by the player.

As would be understood by a person skilled in the art, the interactive settings described in this invention have an impact on the probability of occurrence of winning symbol combinations at the winning line. A game developer can calculate the effect of each interactive setting on said probability of occurrence. For the preferred embodiment, there is a total of twenty seven (27) different settings for the arrow shaped buttons 44 (three different settings for each of the three reels). If we discount, for a moment, the impacts of the "MOVEMENT CONTROL SWITCH" 26 and the "HOLD/RELEASE" switch 50 on movement of the reels, then each of said twenty seven settings is equivalent to a unique "effective" winning line. FIGS. 2-5 indicate all possible settings for the arrow switches, and the corresponding effective winning line for each setting.

For the simplest setting where the "MOVEMENT CONTROL" switch 26 is set to the "OFF" position, and the "HOLD/RELEASE" switch 50 is set to the "RELEASE" position, the occurrence of an effective winning line is deterministic, and is based entirely on the player's setting, i.e., has a probability of occurrence equal to 1. In such a case, the probability of occurrence of a winning combination for the preferred embodiment is simply the probability of occurrence of the winning combination at said deterministic effective winning line.

Alternatively, when the "MOVEMENT CONTROL SWITCH" 26 is set to the "ON" position, and/or if the "HOLD/RELEASE" switch 50 is set to the "HOLD" position, then the movement of a reel (after it comes to a complete stop) becomes dependent on the presence of a symbol either at one position away from the winning line or at the winning line. Because, similar to conventional slot machines, the initial stopping of a reel is controlled by a random number generator, the presence of a symbol either at one position away from the winning line or at the winning line is a probabilistic event. This means that when the "MOVEMENT CONTROL SWITCH" 26 is set to the "ON" position, and/or if the "HOLD/RELEASE" switch 50 is set to the "HOLD" position, the occurrence of an effective winning line, as defined by the arrow switches, becomes a probabilistic event. In such case, there is a plurality of possible effective winning lines for each setting of the arrow switches. Further, each of said possible effective winning lines has a specific probability of occurrence. An example of a set of possible effective winning lines for the particular setting of the arrow switches "DOWN-UP-DOWN" is indicated in FIG. 10. Because when interactive control switches 26 & 50 are activated, the movement of a reel becomes a probabilistic event, there are two possible actions for each reel. Since the arrow switch for the first reel (left) was set to the "DOWN" direction, this reel could move one position down, or could remain at stop. Similarly, the middle reel could move one position up, or could remain at stop. Also, the right reel could move one position down or could remain at stop. Overall, there are a total of eight possible reel actions for the particular setting of "DOWN-UP-DOWN." These actions, and the corresponding effective winning lines are indicated in the eight (8) entries of the table shown in FIG. 10.

Therefore, to calculate the probability of occurrence of a specific winning combination of symbols when the "MOVEMENT CONTROL SWITCH" 26 is set to the "ON" position, and/or if the "HOLD/RELEASE" switch 50 is set to the "HOLD" position, the game designer is required to first analyze the setting of the arrow switches to identify all possible effective winning lines. Second, the game designer calculates the probability of occurrence of each of said possible effective winning lines. Third, the game designer calculates the probability of occurrence of a specific winning combination relative to each of said possible winning lines. Then, the probability of occurrence of the specific winning combination is equal to the sum of the products of the probability of occurrence of a possible effective winning line, and probability of occurrence of the specific winning combination relative to said possible winning line, for all possible winning lines.

The above described process could be used by a game developer to determine the effect of each interactive setting on the probability of occurrence of various winning combinations, and to assess the impact of such interactive setting on the payout ratio of the interactive slot machine. The payout ratio is normally defined as the ratio of the number of coins to be paid out to the whole number of coins spent for games. This process could also be incorporated into an algorithm that would dynamically (in real time) adjust the probability of occurrence of various symbols at an effective wining line to maintain the payout ratio within desired levels.

It should be noted that the above analyses related to the probability of occurrence of a winning combination is being disclosed for the purpose of describing the preferred embodiment, and is not intended to limit the invention herein.

Figure 6:
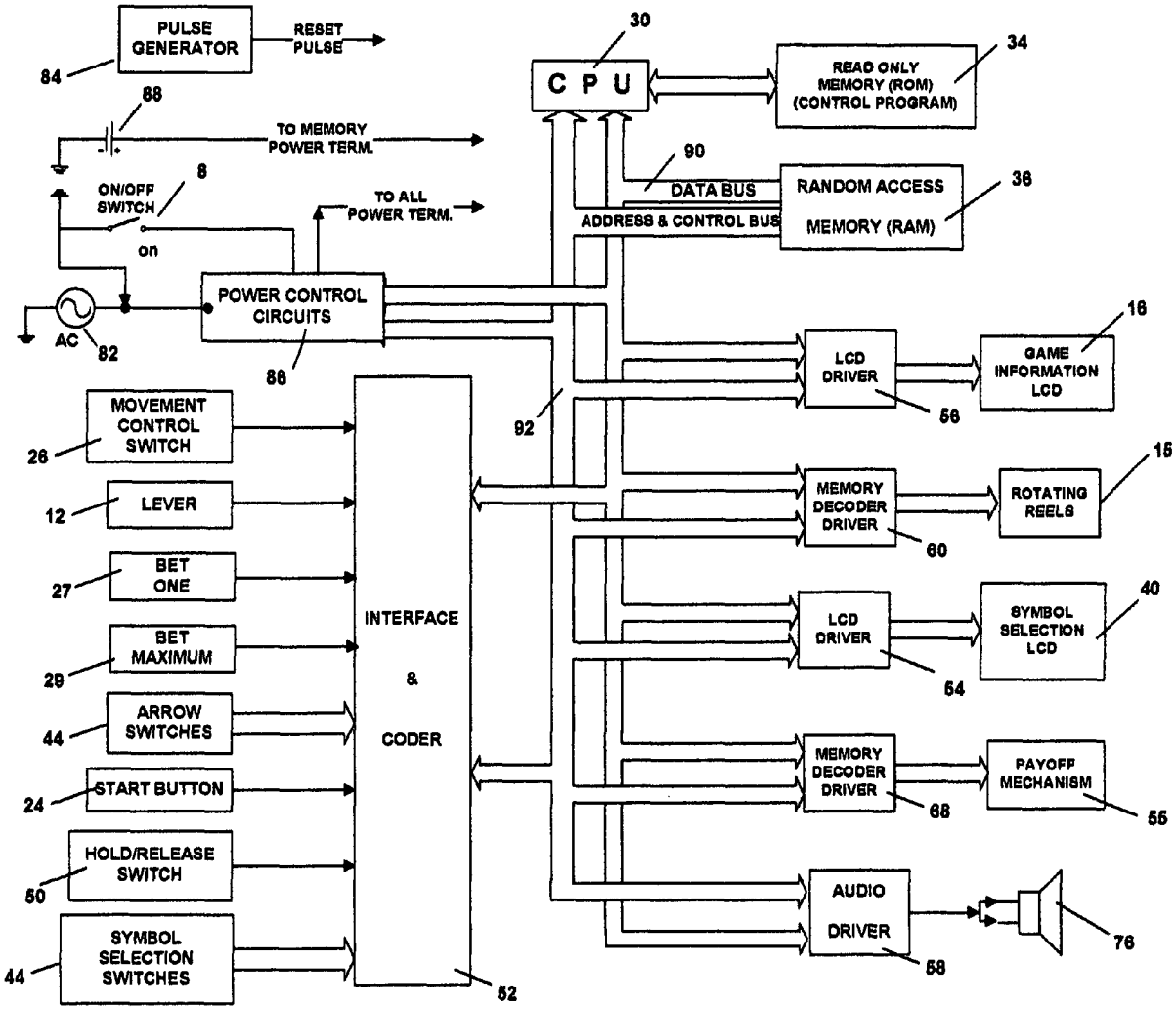
FIG. 6 indicates a block diagram of the microprocessor circuitry used to control the gaming machine according to the invention.

A block diagram of the control circuitry to operate this gaming device 10 is illustrated in FIG. 6. This block diagram includes a micro-controller with a central processing unit (CPU) 30 and system memory. The system memory preferably comprises a separate read-only memory (ROM) 34 and battery-backed random-access memory (RAM) 36. It will be appreciated, however, that the system memory may be implemented on any of several alternative types of memory structures or may be implemented on a single memory structure. For example, the read-only memory 34 may be replaced or supplemented with a mass storage unit such as a removable flash memory or a hard drive. The system memory is used to store game-related data associated with the chance games played on the slot machine. The game-related data may, for example, include game code, math tables, a random number generator, and audio resources.

An on/off toggle switch 8 is provided to control the operational state of the gaming machine and the connection of the external AC power supply 82 to the electric circuitry. Also, an interface and coding device 52 is used as an input interface between the various control elements and the CPU 30. These control elements include the interactive arrow switches 44, movement control switch 26, hold/release switch 50, main lever switch 12, "BET ONE" switch 27, "BET MAX" switch 29, start button 24, and other conventional control elements of a slot machine. Similarly an LCD control driver 56 and an audio driver 58 are used to interface the LCD screen that provides game information 16, and the audio circuits that activate the loudspeaker 76 with the CPU 30. A second LCD driver 54 is used to interface the CPU with the LCD screen 40 that indicates symbol selection. Also, a memory decoder driver 60 is used to interface the rotating reels 15 with the CPU 30. A common address and control bus 92, and a separate common data bus 90 are used to interconnect the central processing unit 30 with the interface and coding device 52, the LCD drivers 54 & 56, the audio driver 58, the read only memory (ROM) 34, and the random access memory (RAM) 36.

Prior to selecting the amount of a wager, and as described herein, the player may establish a setting for the interactive switches to control the movement of the reels after they come to a complete stop. The player may select an amount to wager and other game play functions via the button control panel that includes "BET ONE" 27, and "BET MAX" 29 buttons. The wager amount is signaled to the CPU 30 by a coin/credit detector. In response to the wager, the CPU 30, under the direction of the control program, executes a segment of the game code that, based on a randomly selected outcome, rotates and stops the mechanical reels 15*a*, 15*b*, 15*c* at the selected outcome. Following the stopping of the reels, the CPU 30, under the direction of the control program, executes a segment of the game code (control logic) that, based on the setting of the interactive switches, may move one or a plurality of reels in the direction(s) selected by the player. Also, the CPU 30 selectively accesses the audio resources to be played through one or more audio speakers 76 mounted to a housing of the slot machine. If the outcome after the movement of the reels corresponds to a winning combination outcome identified on a pay table, the CPU 30 instructs a payoff mechanism 55 to award a payoff for that winning outcome combination to the player in the form of coins or credits.

Referring again to FIG. 6, in order to operate the gaming device, the ON-OFF switch 8 should be activated from the "off" position to the "on" position, which causes power to be supplied from the main external power supply 82 to the power control circuits 86, which in turn energize all terminals of the gaming device 10. The gaming device also includes a rechargeable battery 88, which feeds the memory power terminals in order to ensure that critical data is not lost in the event of a loss of the external electrical supply 82.

It should be noted that the above description of the block diagram illustrated in FIG. 6, and using interface and coding devices, and memory decoding devices, is being provided for the purpose of describing the preferred embodiment, and is not intended to limit the invention herein. As would be appreciated by a person skilled in the art, a game designer may elect a microprocessor that includes input and output ports to interface input switches, and output devices with the CPU. Such microprocessors are well known in the art.

Figure 7:
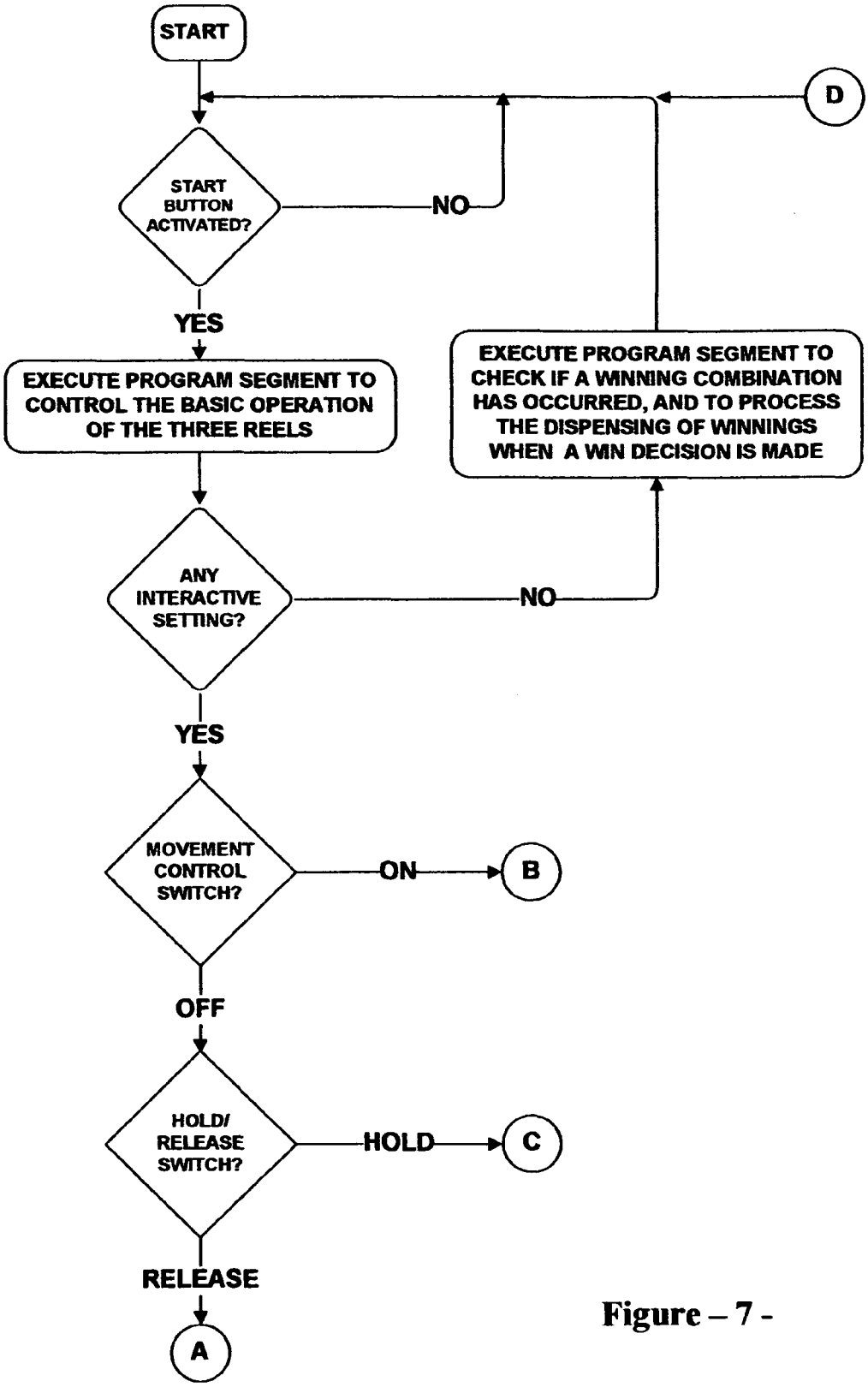
FIGS. 7-9 indicate a logical flow diagram that illustrates the main program functions performed by the microprocessor controlling the gaming machine according to the invention.
Figure 8:
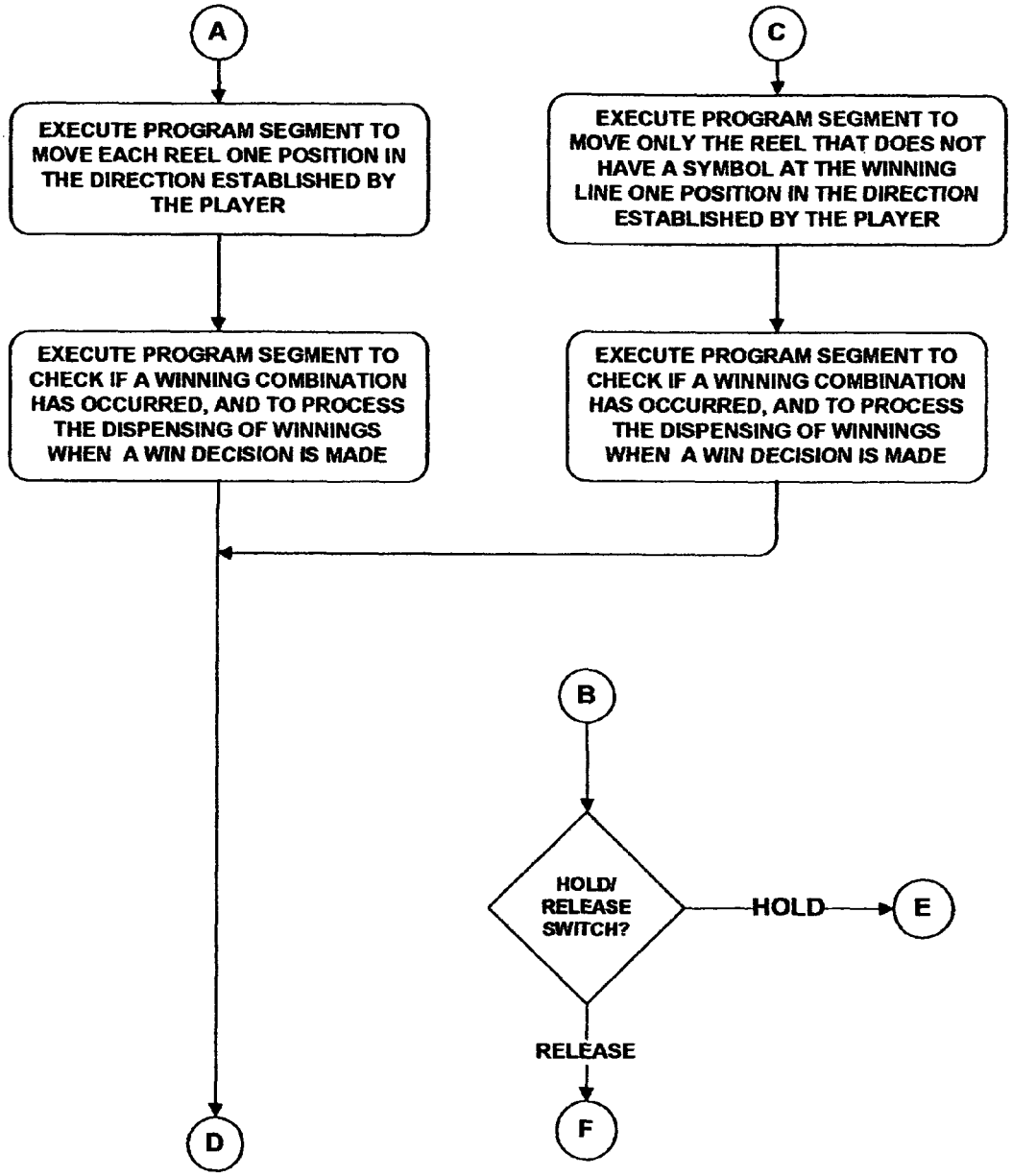
Figure 9:
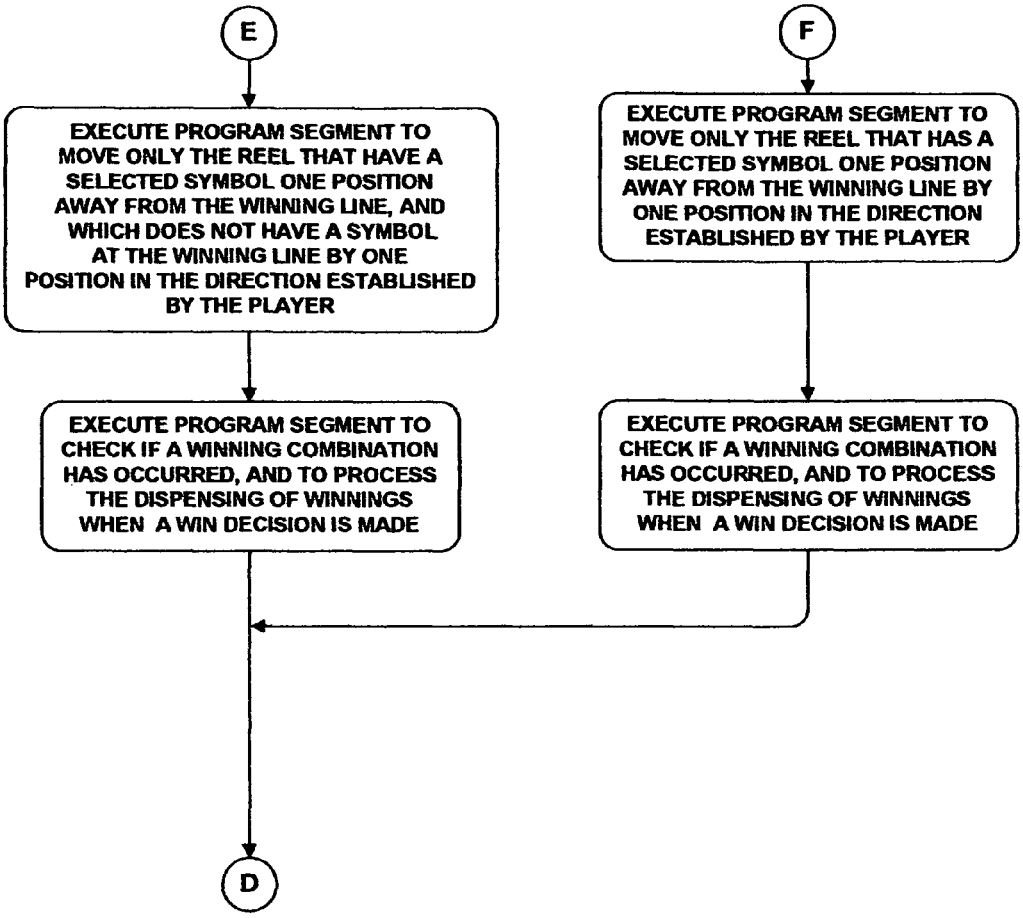

With respect to the operation of this gaming machine, the logic steps utilized are illustrated in flow diagram form in FIGS. 7-9, which interconnect with each other at the places shown in the various figures. Even though specific reference will not be made to this diagram in the following description of the operation of the slot machine, periodic reference to this diagram may prove to be helpful to the reader hereof.

Upon the activation of the "On-Off" switch 8, and the initialization of the program variables, the interactive slot machine is ready to operate. The player is expected to deposit a wager, and activate the interactive settings prior to the activation of the start button or lever. In the absence of such activation, the control program remains in a holding mode. Once the player activates the start button 24 or lever 12, the microprocessor executes a program segment that controls the basic operation of the three reels. As would be understood by persons skilled in the art, this control program segment employs a random number generator, and controls the start and stop of rotation for each reel 15. It should be noted that this program segment could also incorporate an algorithm that dynamically (in real time) adjust the probability of occurrence of each symbol at the winning line based on the interactive settings established by the player, and pursuant to the probability analyses provided herein.

Upon the complete stop of all three reels, the control program checks if the player had activated any of the interactive settings. If the player had not activated any interactive switches, then the microprocessor executes a program segment that first determines if a winning combination has occurred at the winning line, and then processes such winning combination by dispensing coins, or adding an appropriate credit to the player's credit balance.

Alternatively, if the player did activate any of the interactive switches, then the control program checks the positions of the movement control switch, and the hold/release switch. If the movement control switch 26 is in the "OFF" position, and the hold/release switch 50 is in the "RELEASE" position, then the microprocessor executes a program segment to move each reel one position in the direction established by the player using the arrow switches 44. Thereafter, the microprocessor executes the program segment that determines if a winning combination has occurred at the winning line, and processes such winning combination by dispensing coins, or adding an appropriate credit to the player's credit balance. Alternatively, if the movement control switch 26 is in the "OFF" position, and the hold/release switch 50 is in the "HOLD" position, then the microprocessor executes a program segment to move each reel one position in the direction established by the player only if the reel does not have a symbol at the winning line. Thereafter, the microprocessor executes the program segment that determines if a winning combination has occurred at the winning line, and processes such winning combination by dispensing coins, or adding an appropriate credit to the player's credit balance Similarly, if the movement control switch 26 is in the "ON" position, and the hold/release switch 50 is in the "RELEASE" position, then the microprocessor executes a program segment to move only the reels that have a selected symbol one position away from the winning line by one position in the direction established by the player. Thereafter, the microprocessor executes the program segment that determines if a winning combination has occurred at the winning line, and processes such winning combination by dispensing coins, or adding an appropriate credit to the player's credit balance. Alternatively, if the movement control switch 26 is in the "ON" position, and the hold/release switch 50 is in the "HOLD" position, then the microprocessor executes a program segment to move a reel one position in the direction established by the player only if the following two conditions are satisfied: the reel should have a selected symbol located one position away from the winning line, and the reel should not have a symbol located at the winning line. Thereafter, the microprocessor executes the program segment that determines if a winning combination has occurred at the winning line, and processes such winning combination by dispensing coins, or adding an appropriate credit to the player's credit balance.

Upon the completion of the control program segment that checks and processes winning combinations, the control program logic returns to the program segment that determines if the player has activated the start button or lever, after depositing a wager, and the above described process is then repeated.

As will be understood by those skilled in the art, many different programs may be utilized to implement the flow charts disclosed in FIG. 7 through FIG. 9. Obviously these programs will vary from one another in some degree. However, it is well within the skill of the computer programmer to provide particular programs for implementing each of the steps of the flow charts disclosed herein. It is also to be understood that the foregoing detailed description has been given for clearness of understanding only and is intended to be exemplary of the invention while not limiting the invention to the exact embodiment shown. Obviously certain modifications, variations and improvements will occur to those skilled in the art upon reading the foregoing. It is, therefore, to be understood that all such modifications, variations and improvements have been deleted herein for the sake of conciseness and readability, but are properly within the scope and spirit of the following claims.

What is claimed and desired to be secured by Letters of Patent is:

1. A slot machine for presenting a game to a player comprising: a plurality of reels, wherein each of the plurality of reels has a plurality of symbols along its perimeter, at least one pay line, a plurality of switches for the player to interact with the slot machine, a microprocessor with a computer-readable medium encoded with a computer program to control the operation of the slot machine, means for manually selecting, via one of the plurality of switches, at least one of the plurality of reels, and establishing, prior to activating a spinning of the plurality of the reels, a setting for the selected at least one reel to automatically move by one position in a player-specified movement direction after it comes to a stop subsequent to the spinning, means for controlling the selected at least one reel to move by one position in the player-specified movement direction, and means for evaluating the symbol pattern at the at least one pay line for determining a winning combination.

2. A slot machine as recited in claim 1 further comprising a housing.

3. A slot machine as recited in claim 2, wherein said plurality of reels is implemented by mechanical reels.

4. A slot machine as recited in claim 3, wherein said means for manually selecting at least one reel, and establishing a setting for selected reel to automatically move by one position in a specific movement direction includes the activation of at least one switch.

5. A slot machine as recited in claim 3, further comprising means for establishing precise condition for selected reel to move by one position in said specific movement direction, and means for controlling selected reel to move by one position only if the precise condition is met.

6. A slot machine as recited in claim 1, wherein said plurality of reels is implemented by simulated video reels.

7. A slot machine as recited in claim 6, wherein said means for manually selecting at least one reel, and establishing a setting for selected reel to automatically move by one position in a specific movement direction includes the activation of at least one switch.

8. A slot machine as recited in claim 6, further comprising means for establishing precise condition for selected reel to move by one position in said specific movement direction, and means for controlling selected reel to move by one position only of the precise condition is met.

9. A slot machine as recited in claim 8, wherein said precise condition includes a pre-requisite for the presence of a selected symbol at a predetermined position relative to a pay line.

10. A slot machine as recited in claim 8, wherein said precise condition includes prohibiting the movement of a reel in a specific direction after it comes to a stop when a symbol is located at a pay line.

11. A slot machine for presenting a game to a player comprising: a plurality of reels, wherein each of the plurality of reels has a plurality of symbols along its perimeter, at least one pay line, a microprocessor with a computer-readable medium encoded with a computer program to control the operation of the slot machine, a plurality of switches for the player to interact with the slot machine, at least one of the plurality of switches for the player to manually select at least one of the plurality of reels and establish, prior to activating a spinning of the plurality of reels, a setting for the selected at least one reel to automatically move by one position in a player-specified movement direction after it comes to a stop subsequent to the spinning, a computer program segment that controls the selected at least one reel to move by one position in the player-specified movement direction, and a computer program segment to evaluate the symbol pattern at the at least one pay line for determining a winning combination.

12. A slot machine as recited in claim 11 further comprising a housing.

13. A slot machine as recited in claim 12, wherein said plurality of reels is implemented by mechanical reels.

14. A slot machine as recited in claim 13, further comprising at least one switch to establish precise condition for selected reel to move by one position in said specific movement direction, and a computer program segment to control selected reel to move by one position only of the precise condition is met.

15. A slot machine as recited in claim 11, wherein said plurality of reels is implemented by simulated video reels.

16. A slot machine as recited in claim 14, wherein said precise condition includes a pre-requisite for the presence of a selected symbol at a predetermined position relative to a pay line.

17. A slot machine as recited in claim 14, wherein said precise condition includes prohibiting the movement of a reel in a specific direction after it comes to a stop when a symbol is located at a pay line.

18. A slot machine for presenting a game to a player comprising: a housing, a plurality of reels, wherein each of the plurality of reels has a plurality of symbols along its perimeter, a plurality of entry control mechanisms for the player to activate the slot machine, at least one pay line, a microprocessor with a computer-readable medium encoded with a computer program to control the operation of the slot machine, at least one switch for the player to manually select at least one of the plurality of reels and establish, prior to activating a spinning of the plurality of reels, a setting for the selected at least one reel to automatically move by one position in a player-specified movement direction after it comes to a stop subsequent to the spinning, at least one switch for the player to manually establish a precise condition for selected at least one reel to automatically move by one position in the player-specified movement direction, a computer program segment that controls the selected at least one reel to move by one position in the player-specified movement direction after it comes to a stop only if the precise condition is met, and a computer program segment to evaluate the symbol pattern at the at least one pay line for a winning combination.

19. A slot machine for presenting a game to a player comprising: a housing, a plurality of reels, wherein each of the plurality of reels has a plurality of symbols along its perimeter, a plurality of switches for the player to activate the slot machine, at least one pay line, a microprocessor with a computer-readable medium encoded with a computer program to control the operation of the slot machine, at least one switch for the player to manually select at least one of the plurality of reels and establish, prior to activating a spinning of the plurality of reels, a setting for the selected at least one reel to automatically move by one position in a player-specified movement direction after it comes to a stop subsequent to the spinning, a computer program segment that controls the selected at least one reel to move by one position in the player-specified movement direction after it comes to a stop, and a computer program segment to evaluate the symbol pattern at the at least one pay line for a winning combination.

20. A slot machine as recited in claim 19, wherein said plurality of reels is implemented by mechanical reels.

21. A slot machine as recited in claim 19, wherein said plurality of reels is implemented by simulated video reels.

22. A slot machine as recited in claim 18, wherein said plurality of reels is implemented by mechanical reels.

23. A slot machine as recited in claim 18, wherein said plurality of reels is implemented by simulated video reels.

* * * * *